United States Patent [19]

Johnson

[11] 4,205,758

[45] Jun. 3, 1980

[54] REPLACEMENT OIL PAN PLUG

[76] Inventor: Harley D. Johnson, P. O. Box 804, Bradenton, Fla. 33506

[21] Appl. No.: 28,847

[22] Filed: Apr. 10, 1979

[51] Int. Cl.[2] ..... B65D 53/00

[52] U.S. Cl. ..... 220/235; 285/86; 285/277

[58] Field of Search ..... 220/233, 234, 235; 219/208, 336; 285/86, 277; 335/91 B; 251/149.5; 138/89

[56] References Cited

U.S. PATENT DOCUMENTS

| | | | |
|---|---|---|---|
| 2,797,110 | 6/1957 | Covington | 285/86 |
| 3,413,018 | 11/1968 | Francis | 285/86 |
| 3,423,110 | 1/1969 | Hansen et al. | 285/277 |
| 3,489,312 | 1/1970 | Hunckler et al. | 220/235 |

*Primary Examiner*—George T. Hall

*Attorney, Agent, or Firm*—Clarence A. O'Brien; Harvey B. Jacobson

[57] ABSTRACT

A plug assembly is provided including an elongated sleeve defining a longitudinal bore therethrough and including structure thereon for at least semi-permanent sealed securement through the drain bore of an oil pan. The plug assembly further includes a plug member defining an enlarged head and an elongated shank projecting lengthwise outwardly from one side of the head and removably telescopingly receivable in the longitudinal bore through the sleeve. Seal structure is carried by the shank and establishes a slidable fluid tight seal between the shank and the adjacent surfaces of the sleeve bore. The head of the plug member and the adjacent end of the sleeve include coacting structure releasably securing the plug member against outward displacement relative to the sleeve end and thus lengthwise retraction of the shank and the seal structure from the sleeve bore.

11 Claims, 14 Drawing Figures

REPLACEMENT OIL PAN PLUG

BACKGROUND OF THE INVENTION

Internal combustion engine oil pans are provided with threaded drain plugs whereby engine oil may be drained from the oil pan. However, repeated removal and insertion of the threaded drain plugs sometimes results in the threads in the oil pan being damaged to the extent that the threaded plug may no longer form a fluid-tight closure for the oil pan drain bore. Accordingly, various forms of replacement plug assemblies previously have been provided.

Some of these replacement plug assemblies include lengthwise stretchable, and thus radially contractable, resilient plugs, self-threading plugs and plastic plugs. However, these previously known forms of replacement plugs are either difficult to remove when an oil change becomes necessary, require special tools for removal and/or insertion and are themselves limited in effective life span. Accordingly, a need exists for an improved form of replacement oil pan plug which may be repeatedly removed with ease and enjoy an extended expected lifetime of effective operation.

Various forms of plugs, couplings and other structures including some of the general structural and operational features of the instant invention are disclosed in U.S. Pat. Nos. 2,824,945, 2,935,338, 3,097,867, 3,229,069, 3,422,390, 3,423,110 and 3,761,117. However, these previously known structures also fail to provide an effective readily removable and repeatedly usable replacement oil pan plug.

BRIEF DESCRIPTION OF THE INVENTION

The threadless replacement oil pan plug of the instant invention includes a tubular sleeve for permanent or semi-permanent sealed securement through the drain opening of an oil pan and a plug member including a head and an elongated shank projecting lengthwise outwardly from one side of the head and removably telescopingly received in the sleeve from the end thereof on the exterior of the associated oil pan. The shank includes seal structure for establishing a slidable fluid-tight seal between the shank and the sleeve bore and the exterior end portion of the sleeve and the head of the plug member include coacting structure releasably securing the plug member in position with the shank thereof disposed within the longitudinal bore of the sleeve.

The main object of this invention provide an aftermarket replacement oil pan plug assembly which may be readily installed with a minimum of tools.

Another object of this invention is to provide a replacement oil pan plug assembly including a plug member therefor which may be substantially instantly removed for ready draining of oil from the associated oil pan.

Another object of this invention, in accordance with the immediately preceding object is to provide an oil pan plug assembly including a plug member therefor which may be substantially instantly reinstalled after being removed and is automatically self-locking upon reinstallation.

Still another object of this invention is to provide an oil pan plug assembly including a removable plug member which may be readily removed and installed without the utilization of tools.

A final object of this invention to be specifically enumerated herein is to provide a replacement oil pan plug assembly in accordance with the preceding objects and which will conform to conventional forms of manufacture, be of simple construction and easy to use so as to provide a device that will be economically feasible, long lasting and relatively trouble fre in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
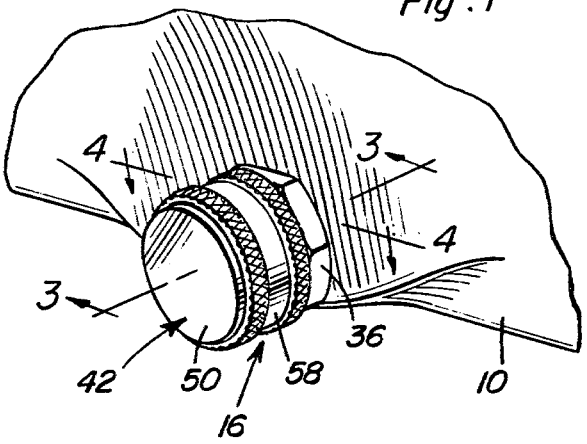
FIG. 1 is a fragmentary perspective view of the drain plug area of a conventional oil pan with a first form of plug assembly constructed in accordance with the present invention operatively associated therewith.
Figure 2:
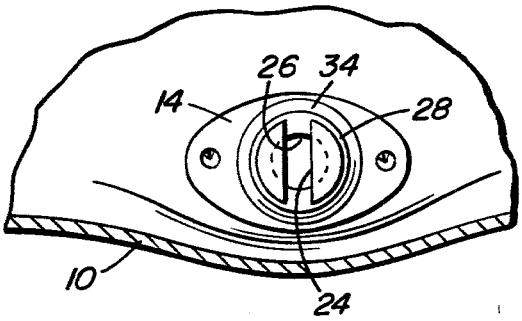
FIG. 2 is a fragmentary vertical sectional view of the assemblage illustrated in FIG. 1 as seen from the inside of the oil pan.

Referring now more specifically to the drawings, the numeral 10 generally designates an oil pan having a conventional drain opening 12 formed therein. An annular reinforcing member 14 is secured to the inner surface of the oil pan 10. Conventionally, the drain opening and reinforcing member are internally coextensively threaded to receive a conventional threaded oil pan plug. However, the threads in the drain opening 12 and the reinforcing member 14 sometimes become damaged and are no longer capable of retaining a conventional threaded oil pan in tightly closed position sealing the drain opening 12.

The first form of replacement plug assembly of the instant invention is referred to in general by the reference numeral 16 and includes an elongated sleeve 18 including first and second ends 20 and 22. The first end 20 of the sleeve 18 is provided with a diametric slot 24 and the sleeve defines a central longitudinal bore 26 opening outwardly of the second end 22 of the sleeve and terminating inwardly of the first end 20 of the sleeve 18, but opening into the slot 24. The sleeve 18 includes an enlarged head 28 adjacent the first end thereof and is externally threaded as at 30 from the head 28 to the second end 22 of the sleeve 18.

A resilient combined sleeve and washer 32 constructed of any suitable material such as neoprene is threaded onto the exterior of the sleeve 18 and includes a circumferentially extending and axailly projecting flange 34. A retaining nut 36 is provided and includes a diametrically reduced sleeve portion 38 projecting outwardly from one end thereof and the sleeve portion 38 includes a circumferential groove 40.

Figure 3:
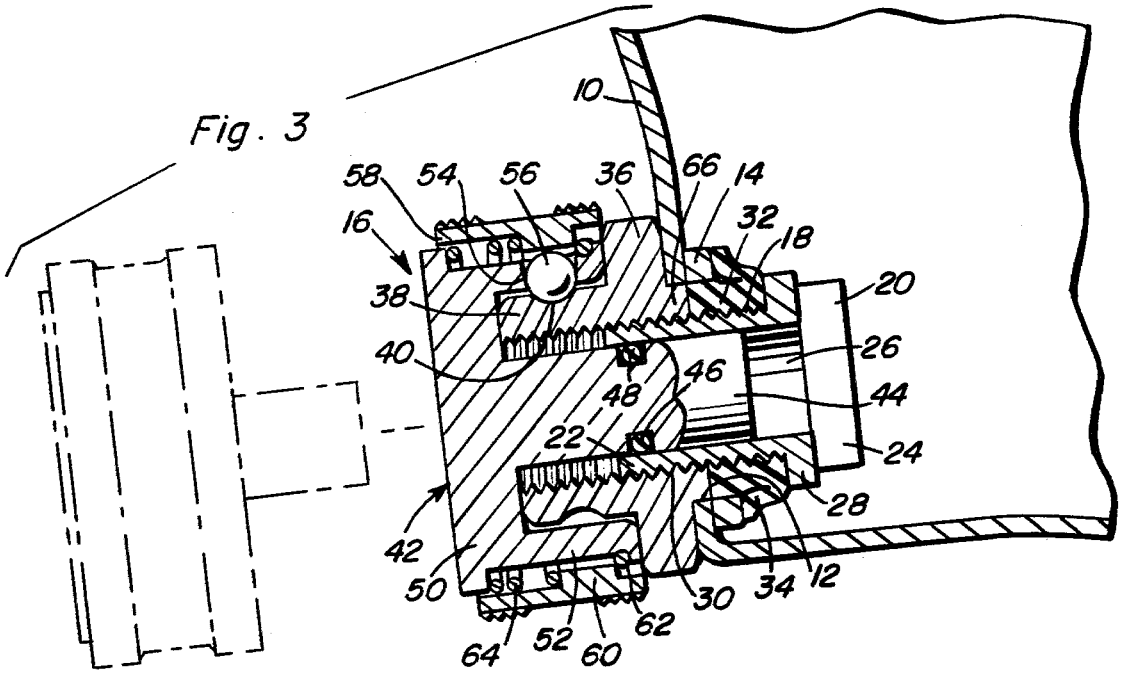
FIG. 3 is an enlarged fragmentary vertical section view taken substantially upon the plane indicated by the section line 3—3 of FIG. 1 and with a removed position of the plug member of the plug assembly illustrated in phantom lines.
Figure 4:
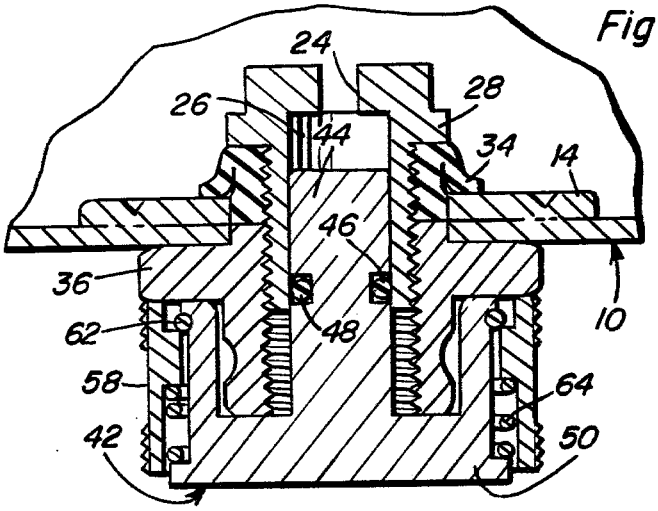
FIG. 4 is an enlarged horizontal sectional view taken substantially upon the plane indicated by the section line 4—4 of FIG. 1.

A plug member referred to in general by the reference numeral 42 is also provided and includes a cylindrical shank 44 having a circumferential groove 46 and an O-ring 48 seated in the groove 46. The groove 46 is formed in the shank 44 centrally intermediate its opposite ends and one end of the shank 44 includes a diametrically enlarged head 50 including an axially projecting cylindrical skirt 52 provided with circumferentially spaced inwardly tapering radial bores 54 in which spherical lock members 56 are seated. A locking sleeve 58 is telescoped over the exterior of the head 50 and the skirt 52 and includes a diametrically reduced mid-portion 60 retained on the skirt 52 at one end by a locking ring 62 and spring biased by spring 64 toward a position with the diametrically reduced portion 60 engaged with the locking ring 62 by a compression spring 64. The compression spring 64, when totally compressed, limits shifting of the sleeve 58 to the right relative to the head 50 as viewed in FIG. 3 and the locking ring 62 limits shifting of the sleeve 58 to the right as viewed in FIG. 3. When the sleeve 58 is shifted to its limit of movement to the left as viewed in FIG. 3 against the collapsed spring 64, the diametrically reduced portion 60 of the locking sleeve 58 uncovers the outer sides of the spherical members 56 and thus enables the latter to unseat themselves from the groove 40 to thereby enable the plug member 42 to be withdrawn from the sleeve 18. Of course, an outward pull on the locking sleeve 58 releases the plug member 42 for disengagement from the sleeve 44 and the nut 36 and thereby enables merely an outward pull on the locking sleeve 58 to effect total disengagement of the plug member 42 from the sleeve 18. When it is desired to reinstall the plug member 42, the sleeve 58 is shifted to its limit position of movement to the left as viewed in FIG. 3 of the drawings, and the plug member 42 is then inserted into the sleeve 18. Thereafter, the locking sleeve 58 may be released in order that the diametrically reduced portion 60 may cam the lock members 56 into seated engagement in the groove 40.

The O-ring seal 48 establishes a fluid-tight seal between the shank 44 and the bore 26 and the flange 34 and radial expansion of the combined sleeve and the washer 32 effect a fluid-tight seal between the sleeve 18 and the annular reinforcing member 14.

Figure 5:
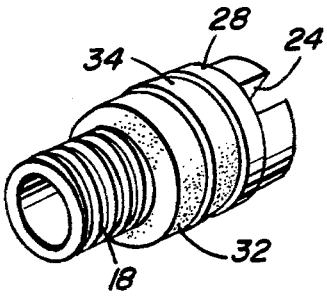
FIG. 5 is a perspective view of the sleeve portion of the oil pan plug assembly with the securing nut therefor removed.
Figure 6:
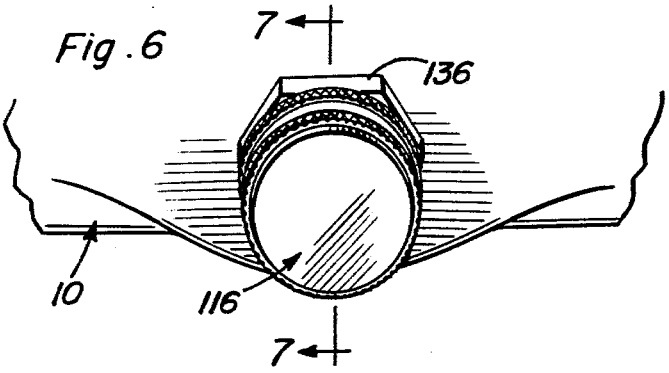
FIG. 6 is a fragmentary perspective view similar to FIG. 1 but illustrating a second form of oil pan plug pan assembly constructed in accordance with the present invention.
Figure 9:
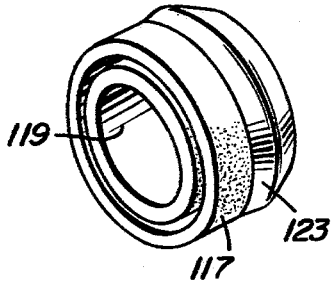
FIG. 9 is a perspective view of the sleeve seal structure of the second form of the oil pan plug assembly.
Figure 7:
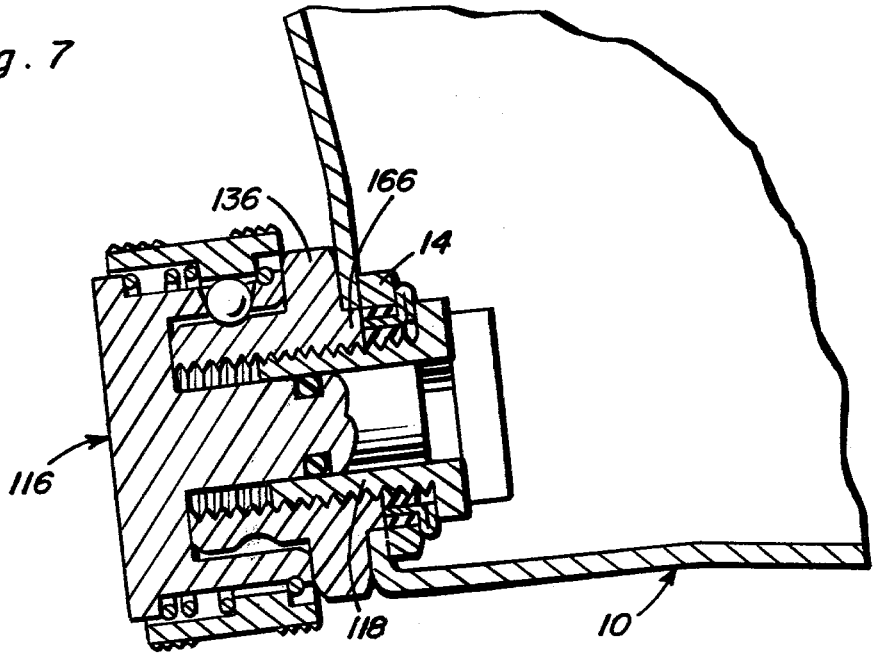
FIG. 7 is an enlarged fragmentary vertical sectional view taken substantially upon the plane indicated by the section line 7—7 of FIG. 6.
Figure 8:
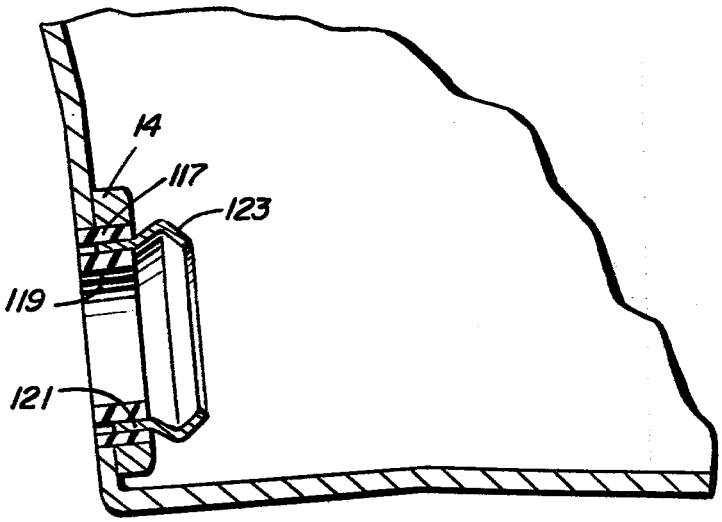
FIG. 8 is a fragmentary vertical sectional view similar to FIG. 7 but with the sleeve retaining nut and plug member removed.

From FIG. 5 of the drawings, it may be seen that the flange 34 is collapsible into a substantially cylindrical condition within an annular recess provided therefor and with an outside diameter substantially equal to the outside diameter of the cylindrical head 28. When it is desired to install the oil pan plug assembly 16, the assemblage comprising the sleeve 18 and the combined sleeve and washer 32 is inserted into the opening 12 and the annular reinforcing member 14. Then, when the flange 34 has cleared the inner side of the reinforcing member 14, the nut 36 is threaded onto the end of the sleeve 18 remote from the head 28 on the exterior of the pan 10. The nut 36 includes a diametrically reduced portion 66 which is snugly received within the drain opening 12 and the combined sleeve and washer is axially compressed and radially expanded between the head 28 and the nut 36 so as to tightly expand within the reinforcing member 14. Further, as the nut 36 is tightened, the head 28 is drawn toward the reinforcing member 14 and the flange 34 has its free end flexed outward and expanded over the inner end of the annular reinforcing member 14. Thus, a reliable fluid tight seal is defined between the sleeve 18 and the reinforcing member 14. Once the sleeve 18, combined sleeve and washer 32 and nut 36 have been installed, it is merely necessary to insert the plug member 42 in the manner hereinbefore set forth.

It is also pointed out that the slot 24 is sufficiently narrow that the blade of a conventional screwdriver of a size to be received through the bore 26 may be received in the slot 24. When the nut 36 is tightened during installation of the sleeve 18, the aforementioned screwdriver blade may be utilized to hold the sleeve 18 against rotation while the nut 36 is tightened.

With attention now invited more specifically to FIGs. 6–9 of the drawings, a second form of plug assembly referred to in general by the reference numeral 116 may be seen. The plug assembly 116 is substantially identical to the plug assembly 16 and therefore has its components corresponding to the various components of the plug assembly 16 referred to by similar reference numerals in the 100 series.

The plug assembly 116 differs from the plug assembly 16 in that three coaxial sleeve members 117, 119 and 121 are utilized in lieu of the combined sleeve and washer 32. The sleeve member 119 is constructed of resilient material and is snugly telescoped within the sleeve member 121. Further, the sleeve member 117 is constructed of resilient material and is snugly telescoped over the sleeve member 121. The sleeve member 121 includes an accordion folded axially compressible and radially expandable portion 123 of a size to be received through the annular reinforcing member 14 and the cylindrical portion of the sleeve member 121 is axially shorter than the sleeve members 117 and 119. Accordingly, as the nut 136 is tightened, the accordion folded portion 123 is axially compressed. In addition, the diametrically reduced portion 166 of the sleeve 136 axially compresses the sleeve members 117 and 119 and when the accordion folded portion 123 is axially compressed, it is increased in outside diameters so that it overlies the inner surface of the annular reinforcing member 14. Thus, at the same time the sleeve retaining accordion folded portion 123 is being axially compressed and radially expanded over the inner surface of the annular reinforcing member 14, the sleeve members 119 and 121 are being axially compressed so as to be radially expanded and thus establish a fluid-tight seal between the annular reinforcing member 14 and the sleeve 118.

Figure 10:
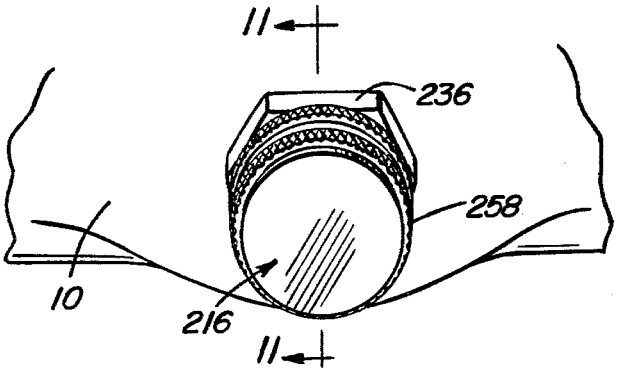
FIG. 10 is a fragmentary perspective view similar to FIG. 6 but illustrating a third form of oil pan plug assembly constructed in accordance with the present invention.
Figure 12:
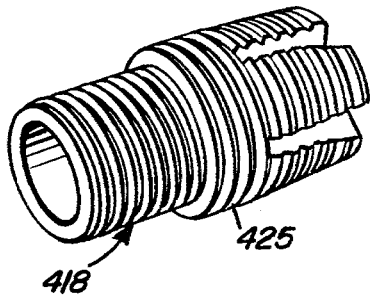
FIG. 12 is a perspective view of the sleeve portion of the third form of oil pan plug assembly.
Figure 11:
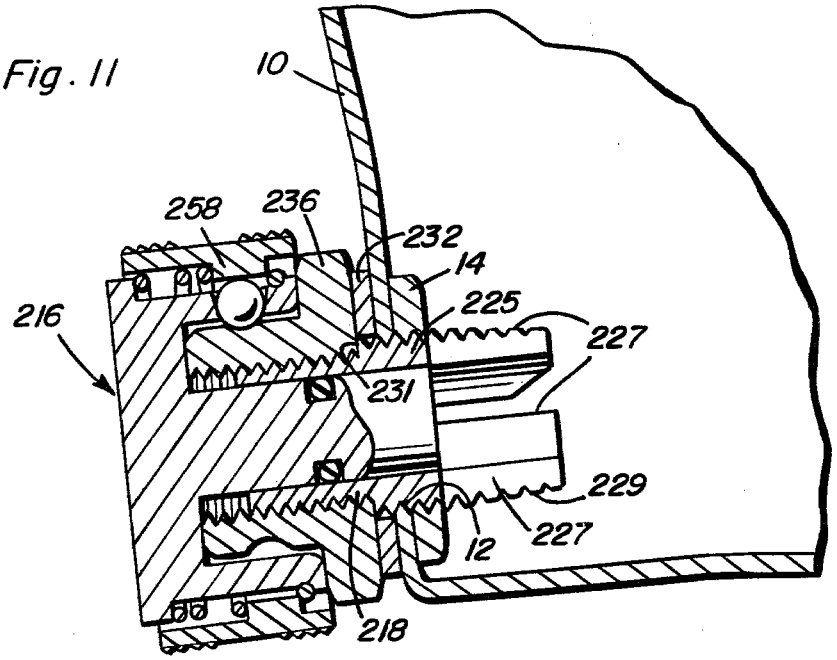
FIG. 11 is an enlarged vertical sectional view taken substantially upon the plane indicated by the section line 11–11 of FIG. 10.

Referring now more specifically to FIGS. 10, 11 and 12 of the drawings, there may be seen a third form of oil pan plug assembly referred to in general by the reference numeral 216. The plug assembly 216 is substantially identical to the plug assembly 16 and therefore has its various components referred to by corresponding reference numerals in the 200 series.

The plug assembly 216 differs from the plug assembly 16 in that the sleeve 218 includes a diametrically enlarged threaded mid-portion 225 into which circumferentially spaced longitudinal slots 227 formed in the inner end of the sleeve 218 extend. The inner end portion of the sleeve 227 includes an external taper 229 to facilitate starting of the sleeve in the drain opening 12 and the reinforcing member 14. The nut 236 is threaded onto the outer end of the sleeve 218 until it abuts the shoulder 231 defined by he diametrically enlarged mid-portion 225 and the nut 236 is then utilized to thread the tapered forward end portion and the threaded mid-portion 225 into the opening 12 and the reinforcing member 14, an annular sealing washer 233 being disposed between the inner side of the nut 236 and the outer surfaces of the oil pan 10 extending about the opening 12. It will be noted that the nut 236 does not include a portion corresponding to the diametrically reduced portion 66 inasmuch as the nut 236 is designed to axially compress the sealing washer 232 between the nut 236 and oil pan 10.

Figure 13:
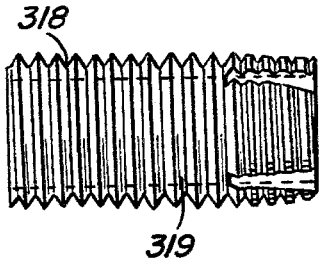
FIGS. 13 and 14 are side elevational views of alternate sleeve portions which may be utilized in the third form of oil pan plug assembly.
Figure 14:
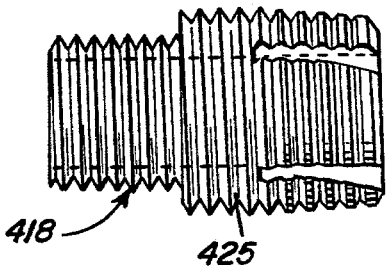

With attention now invited more specifically to FIGS. 13 and 14 of the drawings, it may be seen from FIG. 13 that a second form of sleeve 318 may be provided. The sleeve 318 does not include the equivalent of the diametrically enlarged portion 225 of the sleeve 218, but the corresponding portion of the sleeve 318 includes different external threads 319 whereby a nut corresponding to nut 236 may not be threaded onto the threaded portion 319. Of course, the sleeve 318 is designed to be utilized in conjunction with an oil pan drain opening 12 which is somewhat smaller in diameter than the drain opening 12.

With attention now invited more specifically to FIG. 14 of the drawings, a third form of sleeve referred to in general by the reference numeral 418 is illustrated. The sleeve 418 is substantially identical to the sleeve 218, except that the diametrically enlarged mid-portion 425 thereof corresponding to the diametrically enlarged mid-portion 225 is of even greater diameter. Accordingly, the sleeve member 418 is designed to be utilized in conjunction with larger drain plug openings.

In each of the disclosed forms of the drain plugs, the plug member thereof may be readily removed merely by pulling outwardly on the locking sleeve thereof corresponding to the locking sleeves 58, 158 and 258. The outward pull on the locking sleeve uncovers the outer side with the corresponding lock members 56, 156 and 256 thereby enabling the latter to unseat from the corresponding grooves 40, 140 and 240 and the associated plug member to be readily withdrawn from its supporting sleeve. Of course, reinstallation of either plug member may be as readily accomplished.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A replacement oil pan plug assembly for use as an aftermarket replacement for a threaded shank plug when the mating threads in an associated oil pan drain bore have been damaged, said replacement plug assembly including an elongated sleeve including first and second ends and defining a longitudinal bore therethrough having corresponding first and second end portions, said sleeve including securement means thereon for at least semi-permanent sealed securement through said drain bore, with said first end portion of said bore opening into the interior of said oil pan and the second end of said sleeve projecting outwardly from the exterior of said oil pan disposed about said drain bore, at least said second end portion of said bore being smooth, said plug assembly including a plug member defining a head and an elongated shank projecting lengthwise outwardly from one side of said head and removably telescopingly received in said longitudinal bore second end portion, seal means carried by said shank establishing a slidable fluid-tight seal between said shank and said one end portion of said bore, and said head and the exterior of said second end of said sleeve including coacting means releasably securing said plug member against outward displacement relative to said second end of said sleeve and lengthwise retraction of said shank from said second end portion of said bore.

2. The combination of claim 1 wherein said shank has a circumferential groove formed therein, said seal means comprising an O-ring seal seated in said groove.

3. The combination of claim 1 wherein said securement means includes an enlarged head on said first end of said sleeve and a nut threaded on the second end of said sleeve.

4. The combination of claim 3 wherein said enlarged head is formed integrally with said sleeve.

5. The combination of claim 3 wherein said securement means includes a resilient axially compressible and radially expandable sealing sleeve disposed on said elongated sleeve between said enlarged head and nut.

6. The combination of claim 5 wherein said sealing sleeve includes a radially expandable skirt-type sealing flange thereon adjacent the end of the sealing sleeve opposing said enlarged head.

7. The combination of claim 5 wherein sealing sleeve includes inner and outer concentric telescoped resilient sleeve members and an intermediate thin wall sleeve member of bendable material between said inner and outer sleeve members, the end of said intermediate sleeve member adjacent said enlarged head projecting outwardly from the corresponding ends of said inner and outer sleeve members and being accordion-pleated for axial compression and radial expansion.

8. The combination of claim 7 wherein the end of said intermediate sleeve member remote from said accordion-pleated end is recessed inwardly of the corresponding ends of said inner and outer sleeve members.

9. The combination of claim 1 wherein said securement means includes external threads on said first end of said elongated sleeve and said first end of said elongated sleeve tapers toward the free end thereof and includes circumferentially spaced radial slots formed therein opening outwardly of said free end.

10. The combination of claim 9 wherein said shank has a circumferential groove formed therein, said seal means comprising an O-ring seal seated in said groove.

11. A replacement oil pan plug assembly for use as an aftermarket replacement for a threaded shank plug when the mating threads in an associated oil pan drain bore have been damaged, said replacement plug assembly including an elongated sleeve including first and second ends and defining a longitudinal bore therethrough having corresponding first and second end portions, said sleeve including securement means thereon for at least semi-permanent sealed securement through said drain bore, with said first end portion of said bore opening into the interior of said oil pan and the second end of said sleeve projecting outwardly from the exterior of said oil pan disposed about said drain bore, at least said second end portion of said bore being smooth, said plug assembly including a plug member defining an elongated shank removably telescopingly received in said longitudinal bore second end portion, seal means carried by said shank establishing a slidable fluid-tight seal between said shank and said one end portion of said bore, said second end of said sleeve and said plug member including coacting means releasably securing said plug member against outward displacement relative to said second end of said sleeve and lengthwise retraction of said shank from said second end portion of said bore.

* * * * *